United States Patent [19]

Garrison

[11] 3,966,369

[45] June 29, 1976

[54] INLET AND OUTLET PORTS AND SEALING MEANS FOR A FLUID DRIVEN MOTOR

[75] Inventor: Marion A. Garrison, Denver, Colo.

[73] Assignee: Empire Oil Tool Company, Denver, Colo.

[22] Filed: Mar. 6, 1975

[21] Appl. No.: 556,079

[52] U.S. Cl. ..... 418/149; 418/153; 418/270; 175/107

[51] Int. Cl.[2] ..... F04C 27/00

[58] Field of Search ..... 418/153, 154, 156, 268, 418/15, 104, 149, 259, 270, 260–267, 269; 175/107; 417/405, 406

[56] References Cited

UNITED STATES PATENTS

| | | | |
|---|---|---|---|
| 1,995,755 | 3/1935 | Smith | 418/260 |
| 2,733,663 | 2/1956 | Marshall | 417/406 |
| 2,984,219 | 5/1961 | Mitchell | 418/153 |
| 3,076,514 | 2/1963 | Garrison | 175/107 |
| 3,398,644 | 8/1968 | Wetzel et al. | 418/269 |
| 3,594,106 | 7/1971 | Garrison | 418/153 |

*Primary Examiner*—Carlton R. Croyle
*Assistant Examiner*—O. T. Sessions
*Attorney, Agent, or Firm*—Vincent G. Gioia; Robert F. Dropkin

[57] ABSTRACT

An improved positive displacement motor suitable for use in downhole drilling at the end of a drill string and driven by fluid, e.g., liquid mud, under high pressures. The motor has a novel arrangement of inlet and outlet ports in longitudinally extending circumferentially spaced rows for providing fluid at a substantially uniform pressure along substantially the length of the blades driving the motor so as to equalize the driving torque along the length of the rotor and avoid pressure differentials tending to twist the blade. A continuous ring isolates the adjacent rows of inlet and outlet ports.

10 Claims, 8 Drawing Figures

INLET AND OUTLET PORTS AND SEALING MEANS FOR A FLUID DRIVEN MOTOR

This invention relates to improvements in fluid motors of the kind which are particularly, but not exclusively, suitable for use as down-hole motors in deep well drilling.

BACKGROUND OF THE INVENTION

In the drilling of deep wells the drilling bit may be driven by a positive-displacement type motor located down the hole towards the lower end of a drilling string or casing composed of a number of sections through which liquid mud is fed under pressure to drive the motor, scavenge the hole around the bit and carry away cuttings and the like upwardly to the surface through the annular space between the drilling string and the surrounding wall of the hole.

In order to generate the necessary torque in the motor to drive the drilling bit, high liquid mud pressures are required and the motor is exposed to onerous operating conditions by virtue of such pressures and the nature of the driving liquid.

One particularly suitable type of positive displacement motor comprises a rotor rotatable in a housing with the annular space between the rotor and the housing divided into at least two chambers by longitudinally extending separator strips secured to the wall of the housing with a plurality of flexible blades of considerable length attached to the rotor so that they swing out and engage the housing wall in fluid sealing relationship under the pressure of the liquid mud admitted to the chambers and fold inwardly when they engage the separator strips. The number of blades corresponds to or is a multiple of the number of chambers and as they pass a separator strip they are exposed to an inlet for the liquid mud and as they reach a separator strip the liquid mud escape through an outlet, thus relieving the pressure on the blades and allowing them to fold inwardly.

Examples of such motors are disclosed in my U.S. Pat. Nos. 2,852,230 dated Sept. 16, 1956; 3,076,514 dated Feb. 5, 1963 and 3,594,106 dated July 20, 1971. Such motors disclosed in the prior art referred to are undoubtedly useful in the down-hole drilling of wells but it will be appreciated that the blades are exposed to extremely high liquid mud pressures in order to generate the necessary driving torque. Because of such high fluid pressures and the nature of the driving fluid, the motors operate under extremely onerous conditions and any improvement serving to increase the life of the motor under field operating conditions is important.

The motors disclosed in the prior art referred to above are driven by fluid pressure which enters the motor through inlet ports upstream of fluid flow and leaves the motor through outlet ports downstream of the fluid flow. The fluid pressure to which the flexible blades are exposed is of the order of 400 p.s.i. or greater and the blades are of a length of 20 inches or more. Very high torques are generated in the rotor to drive the drilling bit and as there is a pressure drop across the motor between the fluid inlet and fluid outlet, the turning moment applied to the rotor blades and the rotor is greater at the upstream end of the rotor where the inlet ports are situated than it is at the downstream end of the rotor where the outlet ports are situated. Also it is inherent in the structure that it is the downstream end of the rotor that is exposed to the back reaction torque from the drilling bit that is being driven by the rotor.

Furthermore, as the driving fluid enters the motor at the upstream end and leaves towards the downstream end the fluid, in addition to rotating with the blades about the axis, must also move from the upstream end of the motor to the downstream end thereof thus dissipating some of its energy as such movement does not contribute to driving the blades.

SUMMARY OF THE INVENTION

In a motor as described above inlet and outlet ports are arranged alternately in circumferentially spaced relationship about the housing and sealing means are provided externally of the housing to isolate the inlet ports from the outlet ports and to isolate the inlet ports from one end of the housing and the outlet ports from the other end of the housing.

In a preferred embodiment of the invention there are provided sealing means disposed between the housing and said casing to divide the annular passage therebetween into longitudinally extending inlet passages open to one end of said annular passage and closed to the other end of said annular passage and longitudinally extending outlet passages open to said other end of the annular passage and closed to said one end thereof, the inlet passages alternating with said outlet passages circumferentially about said housing and corresponding in number at least to said number of chambers, a set of inlet ports opening through the wall of the housing from each inlet passage to an associated one of the chambers, a set of outlet ports opening through the wall of the housing from each outlet passage to an associated one of said chambers. Each set of inlet ports comprises a plurality of ports spaced longitudinally of each other in the direction of length of the housing, and each set of outlet ports comprises a plurality of ports spaced longitudinally of each other in the direction of length of the housing.

With advantage, the dimension of inlet passages circumferentially about the housing reduces in the direction from said one end of the annular passage to said other end and the corresponding dimension of the outlet passages increases in said direction.

It is preferred that the sealing means comprises a sealing ring disposed in a sinuous configuration between the housing and the casing.

It is therefore an object of my invention to provide an improved positive displacement motor in which the fluid pressure is substantially equalized along the length of the flexible blades of the rotor.

This and other objects will be more apparent after referring to the following specification and attached drawings in which;

FIG. 1 is a diagrammatic elevational view of the lower end of a down-hole drilling assembly;

FIGS. 2A and 2B when connected on the line Y—Y is a part-sectional view showing the driving motor of the drilling assembly of FIG. 1 to a larger scale;

Figure 1:
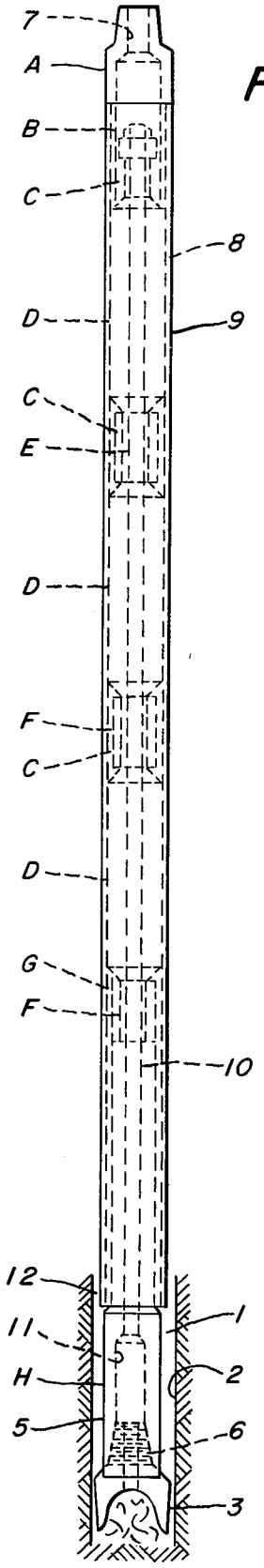

FIG. 1 shows very schematically in elevation a deep well drilling assembly in the position it occupies in a well hole 1 having a circumferential wall 2 formed by a rotation of a drill bit 3. The drilling assembly comprises a head member A adapted for coupling to a corresponding member positioned at the base of the string pipe (not shown) of the drill, a valve B which is either a pressure control valve when gas is used to drive the drill, or a pressure-relief valve and drain valve when liquid is used, as in this example. The valve B is normally closed and opens when flow stops, to fill the string when going into the hole, or to empty the string when coming out. Bearings for motor D are provided at C and E, while at F there is provided a coupling to the motor which includes an end thrust spring to allow longitudinal movement of shaft G in its bearings as the drill 3 meets inequalities in the surface of the bottom of the hole 1. The shaft G is provided with a lower terminal member H which is provided with a cylindrical portion 5 and a tapered screw threaded bore 6 adapted to receive the boring bit 3, which may be of any standard or preferred type.

Operating fluid enters the head member A from the string pipe by axial bore 7 and passes normally around valve B, and enters a circumferential cavity or annular passage 8 between the motor housing and the casing or string 9, entering the motor by way of inlet ports in the motor housing and leaving by discharge ports in the motor housing separated one from the other by sealing means and thence enters a longitudinal axial bore 10 in the shaft and emerges by way of the axial bore 11 in the lower terminal member H in the drill bit 3 where the cuttings from the bottom of the well hole 1 become entrained in the fluid and are carried to the surface by way of space 12 between the casing or string 9 and the wall 2 of the bore hole.

The parts so far described are basically as described in my prior patents and it will be appreciated that the general structure of the deep well drilling assembly may take several different forms depending upon the circumstance under which it is to be used, or as the circumstances change as drilling proceeds.

The positive displacement bladed motor which it is preferred to use in the assembly has been designed bearing in mind in particular its use with liquid mud which inherently contains a proportion of sand or other abrasive matter and also that the pressure of the liquid delivered to the motor may vary over a considerable range, not only where delivered to the string pipe, but principally due to the drop of pressure due to friction upon the surface of the stringer pipe, when the motor is operated at considerable depths. With this problem in mind the blades of the motor and their mode of support upon the rotor have been designed such that the pressure of the blades upon the bore in the housing of the motor varies to only a minor extent with considerable changes of pressure of the fluid, particularly inasmuch as the pressure of the blades is restricted should the pressure of the fluid rise above a desirable value. Thereby wear upon the blades due to any excess pressure and the effect of any abrasive substance in the fluid is reduced to a minimum.

Figure 3:
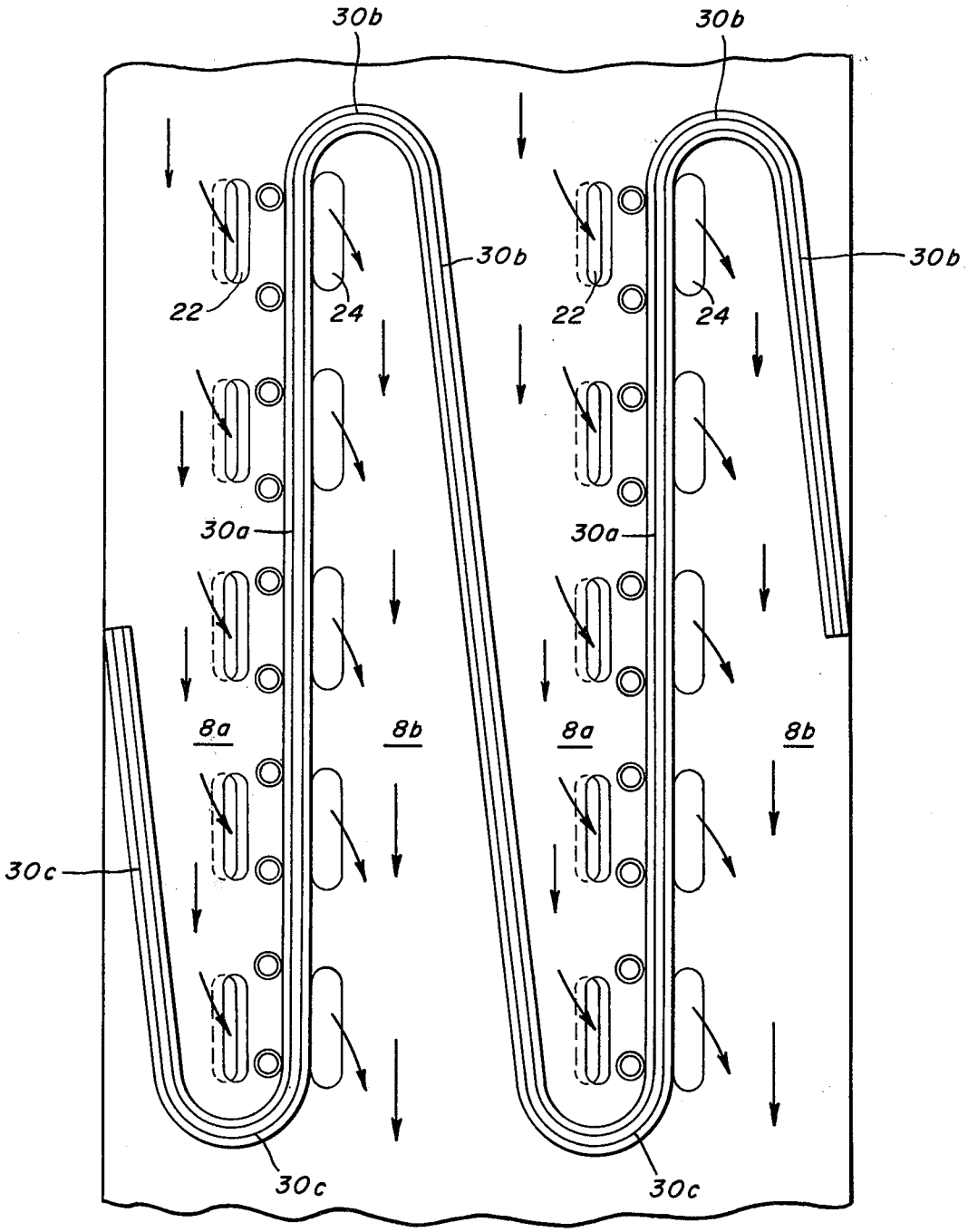
FIG. 3 is fragmentary developed view of the port arrangement of the motor shown in FIGS. 2A and 2B.
Figure 4:
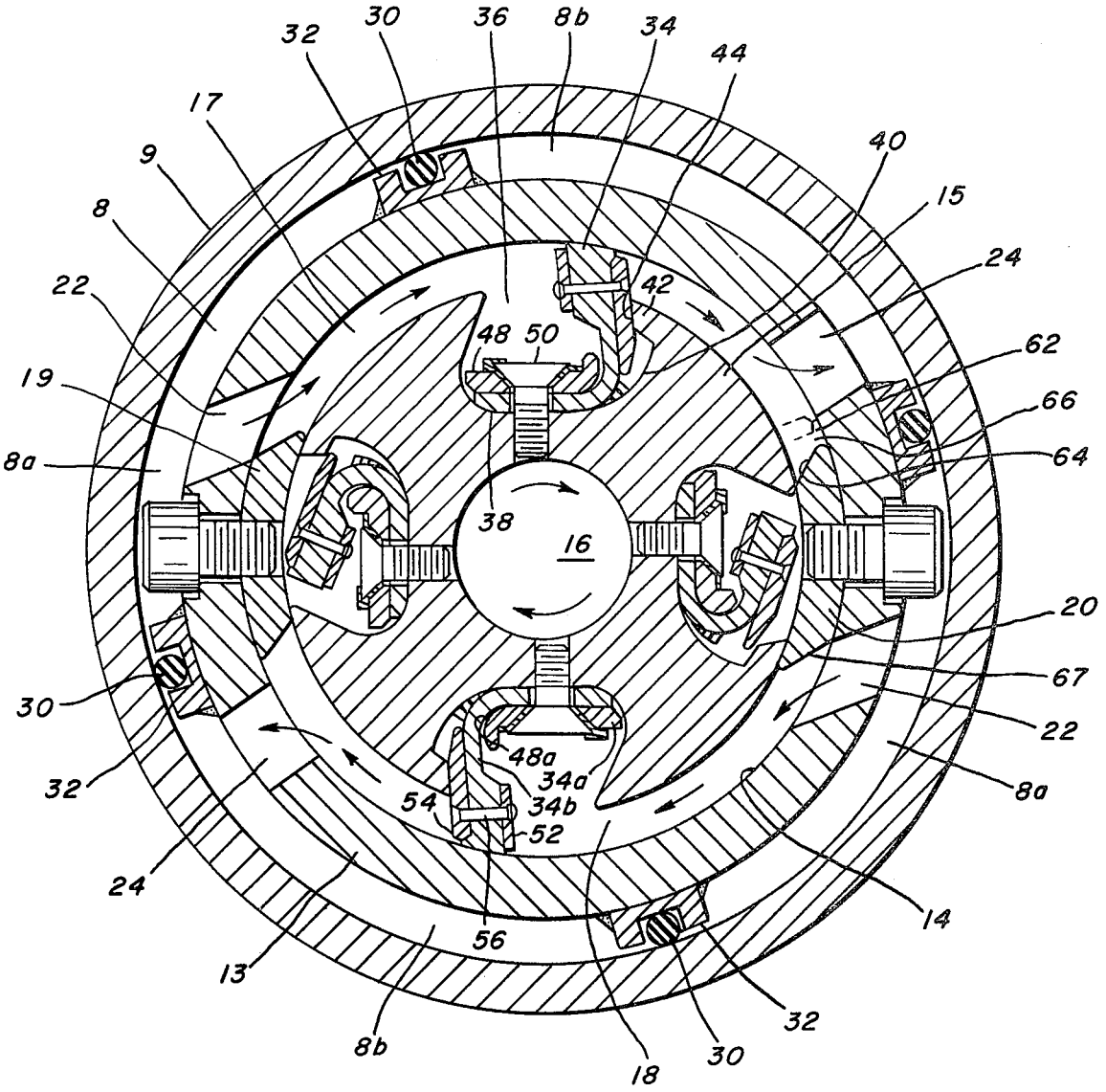
FIG. 4 is a section taken on the line IV—IV of FIG. 2A.

The preferred blade structure as illustrated in FIG. 4 is the subject matter of my co-pending application, Ser. No. 545,866 filed Jan. 31, 1975, and includes a cylindrical housing 13 having a cylindrical bore 14 therein for receiving a cylindrical rotor 15. The rotor 15 has an axial bore 16 therein which may be used as a bypass for fluid as required. The rotor 15 is of smaller diameter than the bore 14 so as to provide a circumferential annular space which is divided into two like chambers 17 and 18 by diametrically opposed longitudinally extending separator strips 19 and 20 which are fastened to the cylindrical bore 14 by screws, while allowing minimum clearance with the rotor 15. Each chamber 17 and 18 is provided with a set of inlet ports 22 and a set of discharge ports 24, each set being formed in the wall of the housing 13 as a plurality of longitudinally spaced apertures to place the chambers 17 and 18 in communication with the annular passage 8 of FIG. 1. Only one of each set can be seen in FIGS. 2A and 2B, but as there is a set of inlet and outlet ports for each chamber 21 and 22 both sets can be seen in the developed view of FIG. 3. The spacing of the ports throughout the length of the motor may be seen by referring to FIGS. 2A, 2B, and 3, the length of the bore 14 preferably being of the order of 20 inches.

The annular passage 8 is divided into longitudinal inlet passages **8*a* and discharge passages 8*b* by a resilient sealing member 30 located in a U-shaped retaining member 32 welded to the exterior of the housing 13. The sealing member 30 makes fluid sealing contact with the inner surface of the casing or pipe string 9, assisted by the difference in pressure on opposite sides thereof. The sealing member 30 is a continuous member unbroken throughout its length, and is of constant cross-sectional shape throughout its length. The member 30 has a straight longitudinal portion 30*a* between and parallel to the associated sets of inlet ports 22 and discharge ports 24, and upper curved portion 30*b* around the discharge ports 24 at the upper end of the motor and extending downwardly away from ports 24, and a lower curved portion 30*c* around the inlet ports 22 at the lower end of the motor and extending upwardly away from ports 22 whereby fluid arriving from above is directed by a tapering passage 8*a* into the inlet ports 22 and directed in a downward direction from the discharge ports 24. The reduction in the circumferential width of the inlet and outlet passages 8*a* and 8*b* is achieved by the path taken by the sealing member 30 between the rows of inlet and outlet ports 22 and 24 opening to and serving the same chamber as can be most clearly seen in FIG. 3. The sinuous path followed by the sealing member 26** is analogous to the shape of a saw-tooth.

The sealing member 30 while being highly effective is both economic to produce and easy to install and replace. Fluid under pressure, admitted upstream of the motor to the inlet end of the annular passage 8 is divided into the inlet passages **8*a* and enters the bore 14 through the inlet ports 22 at intervals for substantially the full axial length of the motor. The reducing circumferential width of the inlet passages 8*a* ensures that the fluid pressure is substantially equal at each inlet port 22 in a longitudinally extending row so that the blades 34 are exposed to uniform driving pressure for substantially the whole of its length. Similarly, the increasing circumferential width of the outlet passages 8*b* in the direction of flow ensures that the pressure at each outlet passage 24 in a row is substantially equal so that the rear face of the blades 34 are exposed to a uniform pressure for substantially the whole of its length and any tendency to distort due to pressure variations along its length are minimized. Furthermore, fluid under pressure admitted through an inlet port 22 needs only to flow circumferentially about the rotor axis to escape through an outlet port 24** thereby minimizing the dissipation of energy inherent in longitudinal flow of the fluid.

Four substantially V-shaped blades 34 are mounted equi-angularly about the periphery of the rotor 15 in longitudinally extending slots or grooves 36 formed in the surface of the rotor. Each groove 36 has a substantially planar base 38 which is normal to a radius of the rotor and which is tangential to an arcuate part 40 of that wall of the groove 29 which may be considered the leading wall considered in the direction of rotation of the rotor 15. This arcuate part 40 terminates at the periphery of the rotor in a stop portion 42 which projects into the groove 36 and provides a planar face 44 against which the blade 34 is supported with its outer edge in sweeping contact with the wall of the bore 14.

Each blade 34 is principally made of an elastomeric material, preferably reinforced with fabric and, when assembled in the motor, is substantially of V-shape in cross-section with the apex of the V curved. Each blade 34 is mounted and secured in a groove 36 by one of its limbs 34*a* which is held in close engagement with planar base 38 of the groove by a metallic strip 48 secured to the rotor body by screws 50 and having a curved or beaded edge 48*a* against which the curved apex of the blade 34 rests. The outer or free limb 34*b* of each blade 34 is the operative or pressure transmitting part of the blade and, in addition to being of greater thickness towards its outer end is also reinforced by reinforcing plates 52 and 54 on the front and rear faces, respectively, secured by a line of rivets 56 extending through the blade. The reinforcing plate 44 on the leading face of the blade portion 34*b* is arranged to abut the stop means 42 when in its outer or driving position and protect the elastomeric material against wear. Furthermore, the stop means 42 is located to provide support at the center of pressure of operative blade portion 34*b* when in its driving position to eliminate any moments generated by fluid pressure which might otherwise tend to rock the blade portion 34*b* about the stop means 42.

As can be seen in FIG. 4, each discharge port 24 is circumferentially spaced a short distance 62 in advance of the associated separator strip 19 or 20 and the leading edge 64 of each separator strip is chamfered or slopes inwardly away from the approaching blade. The effect of this is that as a blade 34 approaches a discharge port 24 it sweeps fluid out through that port until its leading face has passed the port. At that instant, a substantially closed cavity 66 is formed between the leading face of the blade portion 34*b* and the separator strip 19 or 20 and the rotor 15 in which some fluid is trapped. Progressive movement of the rotor 15 and the blade portion 34*b* builds up the fluid pressure in cavity 66 and since the trailing face of the blade portion 34*b* is open to the discharge port 24 and no longer exposed to substantial fluid pressure, the blade portion commences to fold progressively under the influence of the increasing pressure of the trapped fluid. Thus the blade portion 34*b* has already commenced to fold by the time the reinforcing plate strikes the chamfered part 64 of the separator strip thereby materially reducing wear on the blade and vibration of the motor.

Figure 2A:
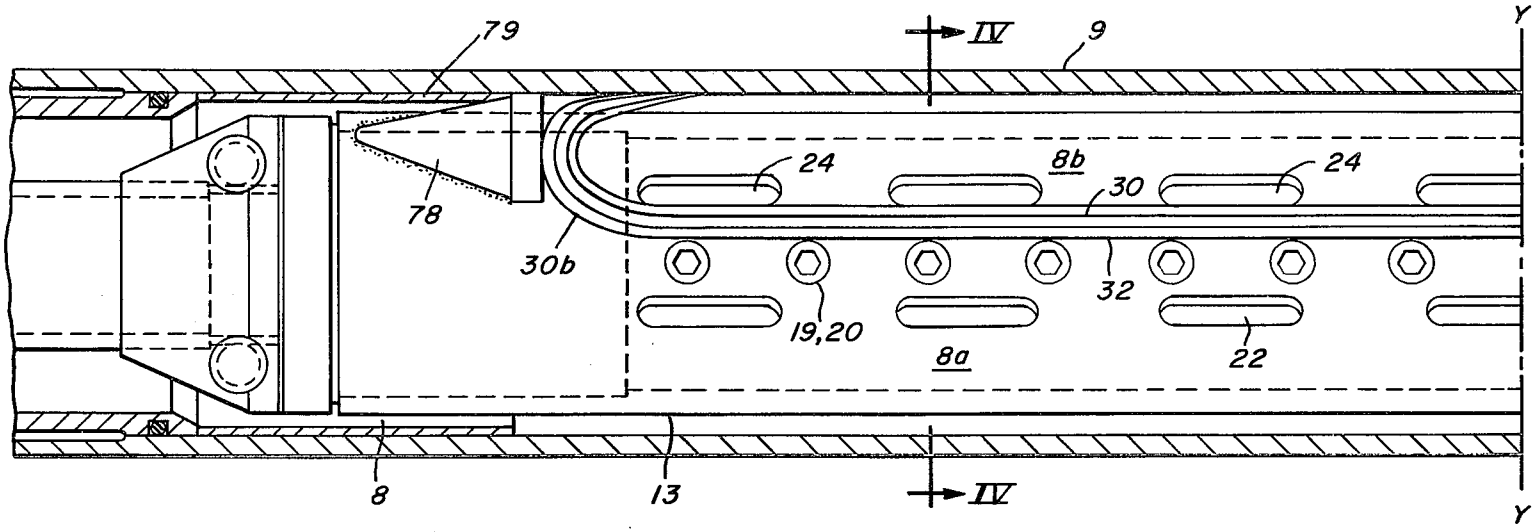
Figure 2B:
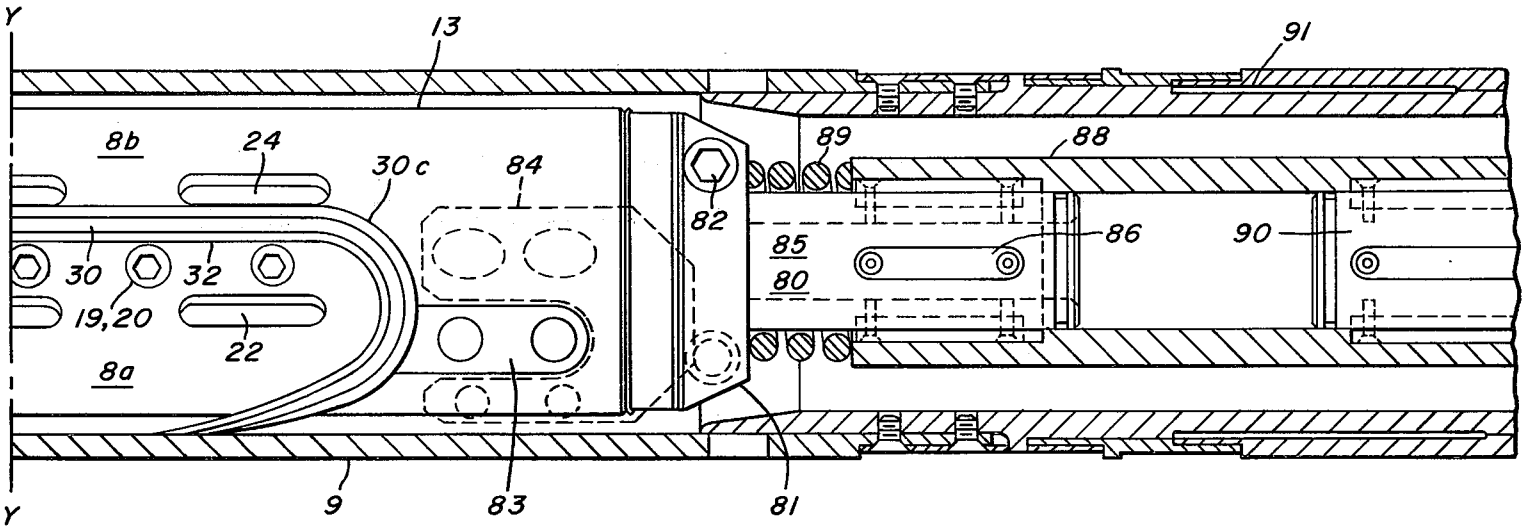

From FIGS. 2A and 2B it will be seen that the motor housing 13, which in the construction described may be of the order of 20 inches long, has five inlet ports 22 and five outlet ports 24 communicating with the interior of the housing 13 and the longitudinal chambers 17 and 18 and on the exterior of the housing 13 with the inlet passages 8*a* and outlet passages 8*b* respectively, which passages are formed by the looped resilient sealing member 30 bridging between the motor housing 13 and the outer casing 9.

The upper end of the motor is located co-axially within the casing 9 by means of circumferentially spaced spacers 78, welded to the housing 13 of the motor, and longitudinally by the spacing sleeve 79 abutting the spacers 78. The spacers 78 are so shaped as to provide as little obstruction as possible to the flow of fluid into the upstream end of the annular passage 8 and preferably opposite the upper bends in the sealing member 30.

The lower end of the rotor is provided with an extension shaft 80 rotatable in a ball race and provided with a screw thread which accommodates a thrust nut 81 having a clamping bolt 82.

The reaction to the torque developed by the motor is transferred to the casing 9 by means of lugs 83 attached to the cylindrical housing 13 of the motor and engaged in slotted stops 84 which are plug welded to the casing 9. The lugs and slotted stops are not shown in FIG. 2B in their correct circumferential position for the sake of clarity.

Two or more motors may be connected in tandem and the connection between two adjacent motors is shown in FIG. 2B. The lower end 85 of the extended motor shaft of the upper motor is connected to the input shaft of the lower motor by a cylindrical sleeve 88, which at the upper end is drivingly connected to the lower end 85 of the upper motor by keys 86 fixed in grooves in the shaft, but is free to move longitudinally against the action of a helical spring 89. At the lower end the sleeve 88 is drivingly connected to the shaft 90 of the lower motor and rests upon the thrust nut 81 of the lower motor. In order that the casing 9 may be extended or shortened as desired and for the insertion and removal of the motors for servicing, it is separable at 91. This feature is not part of the present invention and will be claimed and shown and described in more detail in another application.

Fluid under pressure exiting from the outlet passages 8*b* of the upper motor flows downwardly around the coupling member 88 and into the inlet passages 8*a* of the lower motor.

It will be understood that the number of ports and the mountings for the motor may vary from that described.

Figure 6:
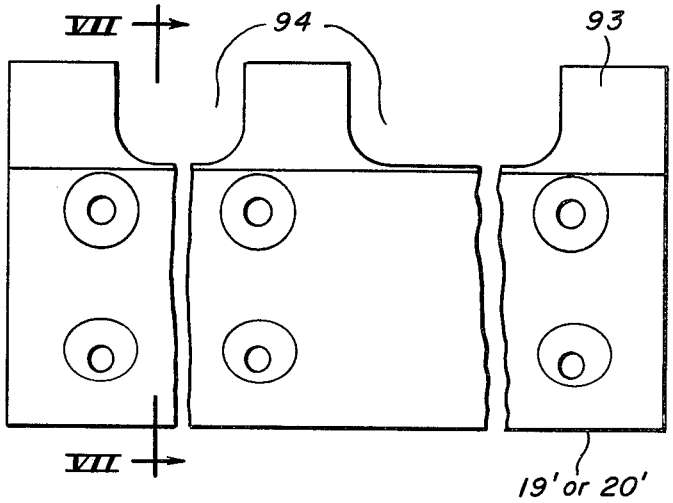
FIG. 6 is an enlarged view of a separator strip of FIG. 5.
Figure 7:
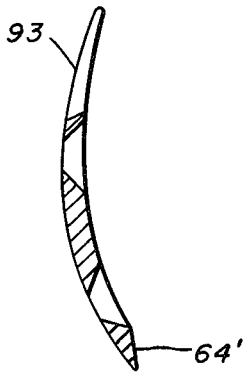
FIG. 7 is a view taken on line VII—VII of FIG. 6.
Figure 5:
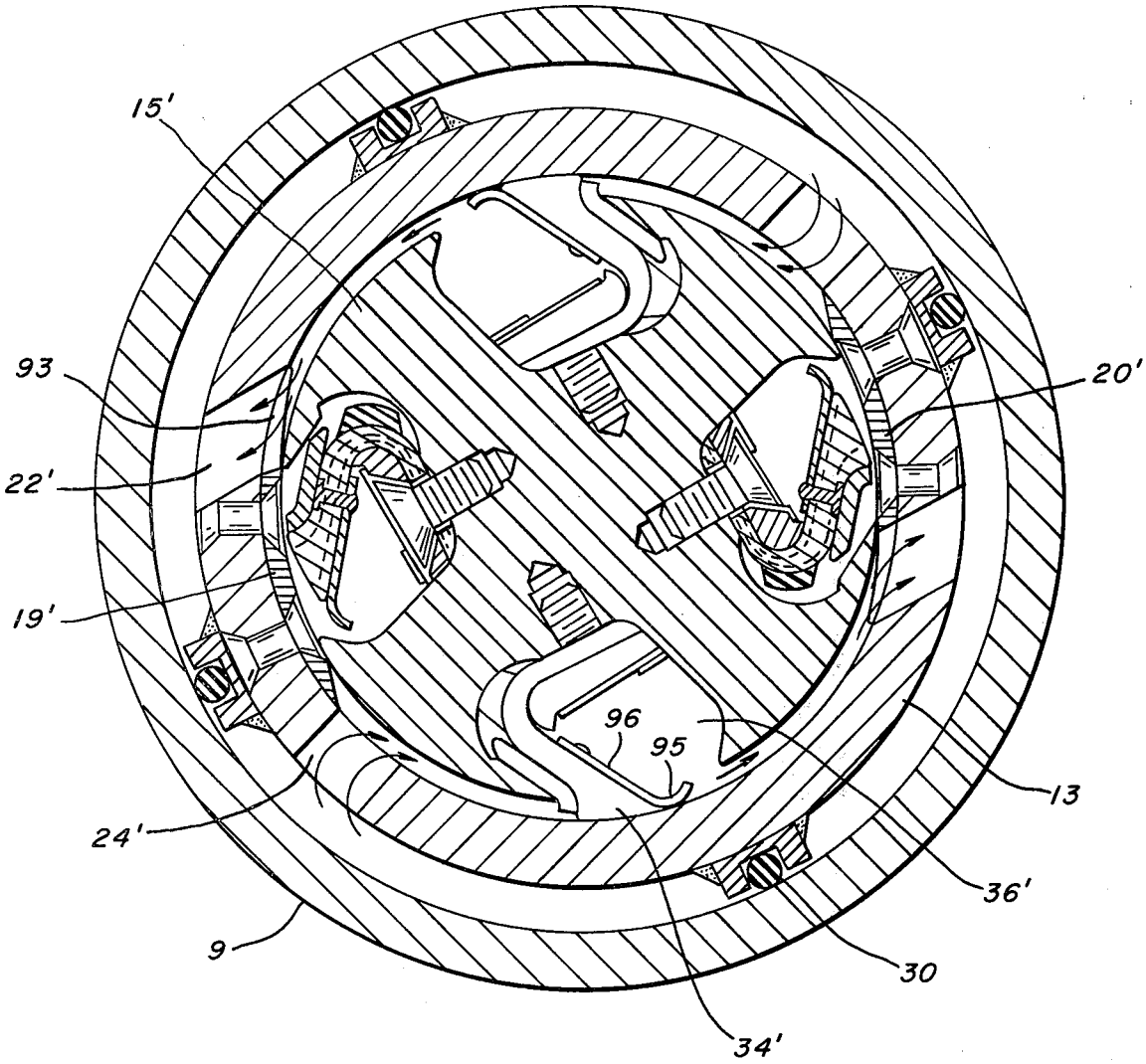
FIG. 5 is a view, similar to FIG. 4, but showing a construction particularly suitable for a pump.

While the invention has been developed principally for use in a motor it may also be used as a pump with minor modifications. FIGS. 5, 6 and 7 show such a modification. The construction of casing 9, motor housing 13 and sealing member 30 are the same as in FIG. 4. The rotor 15′ is larger in diameter than rotor 15 so as to reduce the annular space between the rotor and motor housing. This allows the blades to assume a slightly smaller acute angle when fully open, thus reducing the angle of flex and placing them in a more favorable position for easy entrance upon the ramp. Separator strips 19′ and 20′ are of less thickness than strips 19 and 20 and differ therefrom. Its edge or ramp 64′ is essentially the same as in FIG. 4, but its other edge or ramp 93 extends over port 22′ (which acts as a discharge port when used as a pump) to give it as much length as possible. Ports 94 are cut into the separator strip to permit flow of fluid to port 22′. Grooves 36′ in rotor 15′ and blades 34′ in the grooves are generally the same as in FIG. 4. However, a rounded bend 95 is provided on the outer end of reinforcing strip 96.

When operating as a pump the rotor 15' rotates in a counterclockwise direction as shown in FIG. 5. As the blades 34' approach the ports 22' the bend 95 contacts the ramp 93 smoothly and the blades begin to collapse as soon as they touch the ramps and no fluid can be trapped because the gaps in the ramp lead to ports. When operating as a motor the rotor 15' rotates in a clockwise direction and the operation is the same as in the embodiment of FIG. 4.

It is to be understood that the above description is by way of example only and that details for carrying the invention into effect may be varied without departing from the scope of the invention claimed.

I claim:

1. In a fluid motor or pump comprising a housing having a cylindrical bore therein, a rotor of lesser radial dimension than said bore mounted coaxially for rotation in the bore and defining an annular space between the rotor and said bore, at least two longitudinally extending separator strips provided on the wall of said bore in equal circumferentially spaced relationship and dividing said annular space into a corresponding number of circumferentially spaced longitudinally extending chambers, a plurality of flexible resilient longitudinally extending blades attached to said rotor and extending outwardly therefrom to sweep said chambers, said blades being inwardly foldable to pass said separator strips, inlet port means opening through the housing to each chamber to supply fluid pressure thereto, and outlet port means opening through the housing from each chamber to discharge fluid therefrom; the improvement comprising locating said inlet and outlet port means in the same longitudinal location alternately in circumferentially spaced relationship about the housing and providing sealing means externally of said housing extending longitudinally between said inlet port means and said outlet port means and isolating said inlet port means from said outlet port means and from one end of said housing and isolating said outlet port means from the other end of said housing.

2. The combination of claim 1 in which said inlet port means includes a row of inlet ports spaced longitudinally of each other in the direction of length of said housing, and said outlet port means includes a row of outlet ports spaced longitudinally of each other in the direction of length of said housing.

3. The combination of claim 2 including a casing surrounding said housing and defining an annular passage about said housing, said sealing means extending between said casing and said housing.

4. The combination of claim 3 in which said sealing means comprises a sealing member having a straight portion located between said row of inlet ports and said row of outlet ports, a curved portion around the inlet port at one end of the housing and extending away from the outlet ports toward the other end of said housing to provide an inlet passage reducing in circumferential width from said other end toward said one end closing said annular passage, and a curved portion around the outlet port at said other end of the housing and extending away from the inlet ports toward the said one end of said housing and closing the annular passage to provide an outlet passage increasing in circumferential width from said other end toward said one end, said curved portions being connected to said straight portion.

5. The combination of claim 4 in which said sealing member includes a U-shaped retaining member welded to one of said housing and casing with an opening toward the other one of said housing and casing, and a resilient member in said opening.

6. In a motor or pump comprising a housing having a cylindrical bore therein, a rotor mounted coaxially for rotation in said bore, inlet port means opening through said housing, and outlet port means opening through said housing and spaced circumferentially from said inlet port means; the improvement comprising locating said inlet and outlet port means in the same longitudinal location alternately in circumferentially spaced relationship about the housing and providing sealing means externally of said housing isolating said inlet port means from said outlet port means and from one end of said housing and isolating said outlet port means from the other end of said housing.

7. The combination of claim 6 in which said inlet port means includes a row of inlet ports spaced longitudinally of each other in the direction of length of said housing, and said outlet port means includes a row of outlet ports spaced longitudinally of each other in the direction of length of said housing.

8. The combination of claim 7 including a casing surrounding said housing and defining an annular passage about said housing, said sealing means extending between said casing and said housing.

9. The combination of claim 8 in which said sealing means comprises a sealing member having a straight portion located between said row of inlet ports and said row of outlet ports, a curved portion around the inlet port at one end of the housing and extending away from the outlet ports toward the other end of said housing to provide an inlet passage reducing in circumferential width from said other end toward said one end closing said annular passage, and a curved portion around the outlet port at said other end of the housing and extending away from the inlet ports toward the said one end of said housing and closing the annular passage to provide an outlet passage increasing in circumferential width from said other end toward said one end, said curved portions being connected to said straight portion.

10. The combination of claim 9 in which said sealing member includes a U-shaped retaining member welded to one of said housing and casing with an opening toward the other one of said housing and casing, and a resilient member in said opening.

* * * * *